US007819756B2

(12) United States Patent
Ban et al.

(10) Patent No.: US 7,819,756 B2
(45) Date of Patent: Oct. 26, 2010

(54) GOLF CLUB HEAD

(75) Inventors: Wataru Ban, Chichibu (JP); Fumiaki Sato, Chichibu (JP); Kozue Wada, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 32 days.

(21) Appl. No.: 12/238,106

(22) Filed: Sep. 25, 2008

(65) Prior Publication Data

US 2009/0247318 A1 Oct. 1, 2009

Related U.S. Application Data

(63) Continuation-in-part of application No. 12/125,382, filed on May 22, 2008, now abandoned.

(30) Foreign Application Priority Data

Apr. 1, 2008 (JP) ..... 2008-095417
Aug. 8, 2008 (JP) ..... 2008-206386

(51) Int. Cl.
*A63B 53/04* (2006.01)

(52) U.S. Cl. ..... 473/330

(58) Field of Classification Search ..... 473/324–350
See application file for complete search history.

(56) References Cited

U.S. PATENT DOCUMENTS

| | | | |
|---|---|---|---|
| 3,869,126 | A | 3/1975 | Thompson |
| 5,029,864 | A | 7/1991 | Keener |
| 5,618,239 | A | 4/1997 | Rife |
| 5,688,190 | A | 11/1997 | Rowland et al. |
| 5,690,561 | A | 11/1997 | Rowland et al. |
| 5,709,616 | A | 1/1998 | Rife |
| 5,792,004 | A | 8/1998 | Nagamoto |
| 2005/0245329 | A1 | 11/2005 | Nishitani et al. |
| 2005/0250594 | A1 | 11/2005 | Nishitani et al. |
| 2008/0125241 | A1 * | 5/2008 | Tateno et al. ..... 473/331 |

FOREIGN PATENT DOCUMENTS

| | | | |
|---|---|---|---|
| JP | 8-206260 | A | 8/1996 |
| JP | 08-206260 | A | 8/1996 |
| JP | 9-56855 | A | 3/1997 |
| JP | 09-99120 | A | 4/1997 |
| JP | 09-253250 | A | 9/1997 |
| JP | 10-000250 | A | 1/1998 |
| JP | 10-000251 | A | 1/1998 |
| JP | 2825022 | B2 | 9/1998 |
| JP | 2926702 | B2 | 5/1999 |
| JP | 2002-779 | A | 1/2002 |
| JP | 2004-674 | A | 1/2004 |
| JP | 2005-312619 | A | 11/2005 |
| JP | 2005-319019 | A | 11/2005 |

* cited by examiner

*Primary Examiner*—Alvin A Hunter
(74) *Attorney, Agent, or Firm*—Paul, Hastings, Janofsky & Walker LLP

(57) ABSTRACT

This invention provides a golf club head including a plurality of score lines on the face. The golf club head includes a plurality of striations formed on the face and extending from a toe side to a heel side. The cross-sectional shape of each of the striations is a triangle asymmetric with regard to a virtual center line in the width direction, and the smallest interior angle among three interior angles of the triangle is placed at the sole side of the golf club head. A depth D from the face to the deepest portion of each of the striation satisfies 10 μm≦D≦40 μm.

22 Claims, 9 Drawing Sheets

FIG. 9

| | POSITION OF SMALLEST INTERIOR ANGLE | DEPTH D (μm) | PITCH P (μm) | SURFACE ROUGHNESS (Ra) | SPIN AMOUNT | SCRATCH | RULE CONFORMANCE |
|---|---|---|---|---|---|---|---|
| #1 | | | | 0.3 | E | ALMOST NO SCRATCH | ○ |
| #2 | UPPER PORTION SIDE | 20 | 400 | 3.9 | | | |
| #3 | | 40 | | 7.8 | D | | × |
| #11 | SOLE SIDE | 10 | | 1.9 | | | ○ |
| #12 | | 25 | | 4.4 | B | | |
| #13 | | 40 | | 7.9 | A | SOME SCRATCHES | × |
| #14 | | 20 | 100 | 5.2 | D | ALMOST NO SCRATCH | × |
| #15 | | | 400 | 3.9 | C | | ○ |
| #16 | | | 600 | 2.8 | | | |
| #17 | | | 800 | 1.7 | D | | |

GOLF CLUB HEAD

This is a continuation-in-part application of U.S. patent application Ser. No. 12/125,382 filed on May 22, 2008, entitled "GOLF CLUB HEAD".

BACKGROUND OF THE INVENTION

1. Field of the Invention

The present invention relates to a golf club head.

2. Description of the Related Art

Generally, on the face of a golf club head, a plurality of straight grooves are formed parallel to each other in the toe-and-heel direction. These grooves are called score lines, marking lines, face lines, or the like (to be referred to as score lines in this specification). These score lines have an effect of increasing the backspin amount of a shot or suppressing a significant decrease in the backspin amount rate of a shot in case of a rainy day or a shot from the rough.

U.S. Pat. Nos. 3,869,126 and 5,029,864 each disclose a golf club head in which grooves having triangular cross sections are formed on the face as grooves similar to score lines. U.S. Pat. Nos. 5,618,239 and 5,709,616 each disclose a golf club head (patter head) in which grooves having triangular cross sections are formed on the face. U.S. Pat. Nos. 5,688,190 and 5,690,561 each disclose a golf club head in which a pad having a plurality of ribs is stuck to the face. Japanese Patent Laid-Open No. 09-253250 discloses a golf club head in which grooves smaller than score lines are formed on the face in addition to the score lines.

The increase in the backspin amount of a shot obtained by changing the design of score lines is limited. Like a golf club head disclosed in Japanese Patent Laid-Open No. 09-253250, forming grooves in addition to score lines is effective in increasing the backspin amount of a shot. However, when grooves are formed in addition to score lines, a ball may be damaged.

SUMMARY OF THE INVENTION

It is an object of the present invention to provide a golf club head which can provide the higher backspin amount while suppressing damage to a ball.

According to the present invention, there is provided a golf club head including a plurality of score lines on a face, comprising a plurality of striations formed on the face and extending from a toe side to a heel side, wherein a cross-sectional shape of each striation is a triangle asymmetric with regard to a virtual center line in a width direction, the smallest interior angle among three interior angles of the triangle being placed at a sole side of the golf club head, and a depth D from the face to the deepest portion of each striation satisfies $10\ \mu m \leqq D \leqq 40\ \mu m$.

Further features of the present invention will become apparent from the following description of exemplary embodiments (with reference to the attached drawings).

BRIEF DESCRIPTION OF THE DRAWINGS

FIG. 9 is a table showing the presence/absence of striations and their specifications of golf club heads #1 to #3 and #11 to #17, the evaluation results of the backspin amounts and degrees of scratch of balls, and the rule conformance associated with the surface roughness of the face.

DESCRIPTION OF THE EMBODIMENTS

Figure 1:
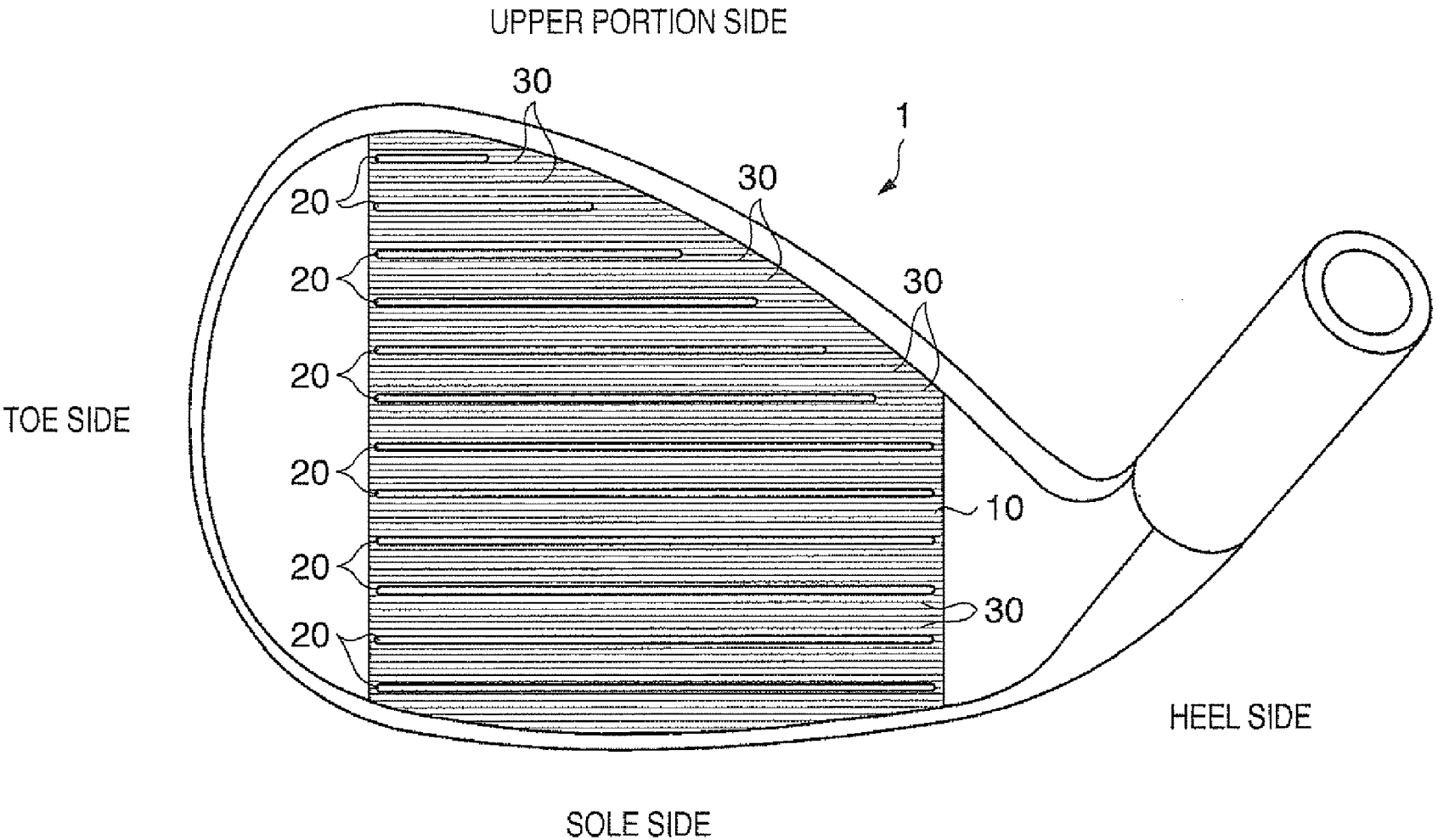
FIG. 1 is a view showing the outer appearance of a golf club head 1 according an embodiment of the present invention.

FIG. 1 is a view showing the outer appearance of a golf club head 1 according to an embodiment of the present invention. FIG. 1 shows an example in which the present invention is applied to an iron golf club head. The present invention is suitable for iron golf club heads, and particularly for middle iron golf club heads, short iron golf club heads, and wedge golf club heads. More specifically, the present invention is suitable for golf club heads with loft angles of 30° to 70° (both inclusive) and head weights of 240 g to 320 g (both inclusive). However, the present invention is also applicable to wood or utility (hybrid) golf club heads.

Figure 2:
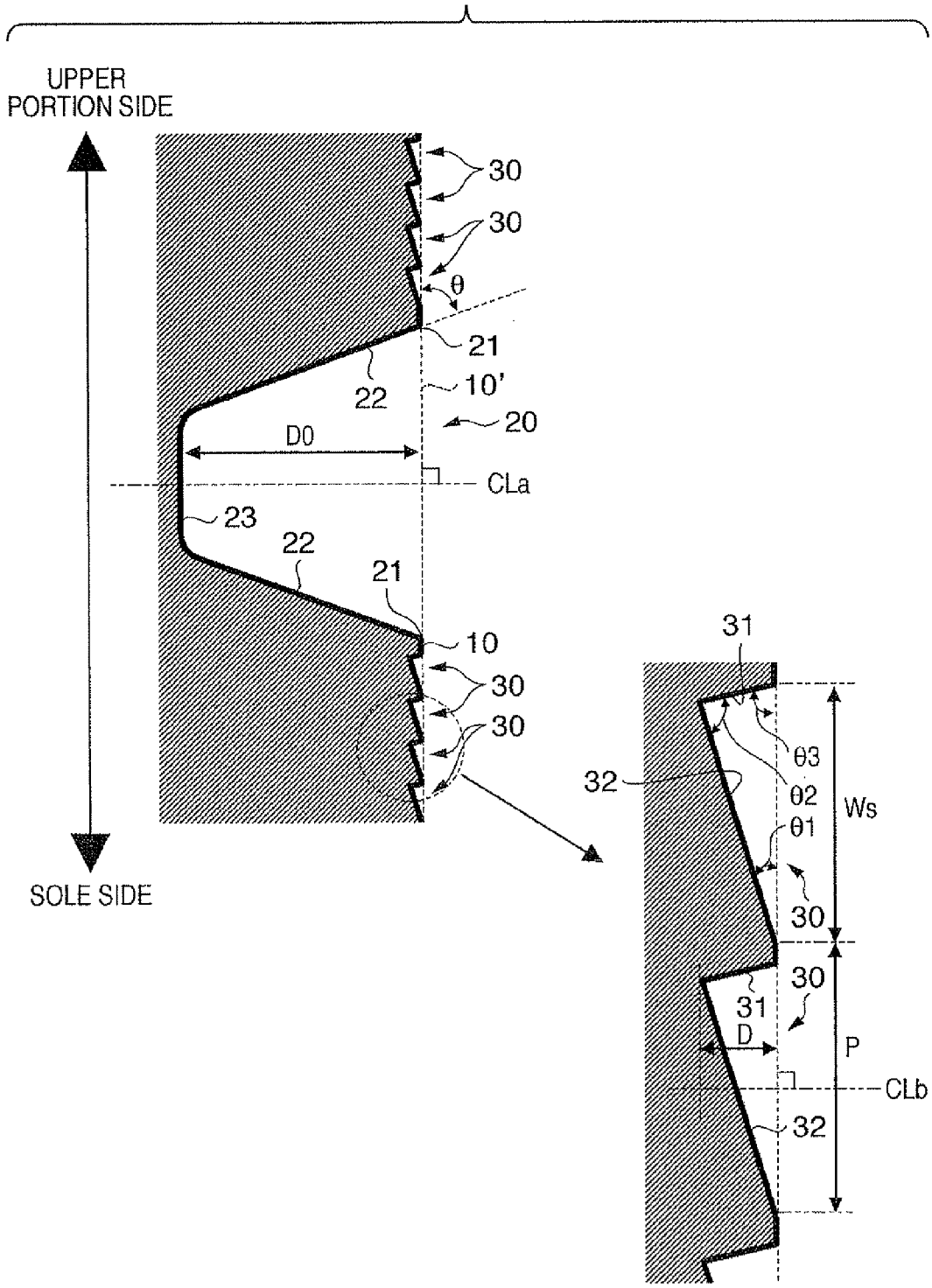
FIG. 2 shows a sectional view of a score line 20 and striations 30 in a direction perpendicular to the longitudinal direction (toe-and-heel direction), and an enlarged sectional view of the striations 30.

The golf club head 1 has a plurality of score lines 20 formed on its face (striking face) 10. The respective score lines 20 are straight grooves extending in the toe-and-heel direction and parallel to each other. The golf club head 1 also has a plurality of striations 30. In this embodiment, the striations 30 are straight grooves parallel to the score lines 20 and extending in the toe-and-heel direction. However, they may be arcuate or elliptically arcuate grooves extending in the toe-and-heel direction. FIG. 2 shows a sectional view of the score line 20 and striations 30 in a direction perpendicular to the longitudinal direction (toe-and-heel direction), and an enlarged sectional view of the striations 30. In FIG. 2, a dashed line 10' represents a virtual line on the same plane as the face 10. The score lines 20 will be described first.

In this embodiment, the cross-sectional shapes of the score lines 20 are the same except in two end portions in the longitudinal direction. The score lines 20 have the same cross-sectional shape. In addition, in this embodiment, the cross-sectional shape of the score line 20 is symmetric with regard to a virtual center line CLa in the width direction. The virtual center line CLa is perpendicular to the face 10 and passes the middle point of a width W of the score line 20. In this embodiment, the cross-sectional shape of the score line 20 is a trapezoid, but it may be another shape such as a V-shape.

The score line 20 has a pair of side surfaces 22 and a bottom surface 23. An edge 21 of the score line 20 is the boundary portion of the side surface 22 and face 10. The edge 21 may be rounded. An angle θ is the angle between the side surface 22 and face 10. The larger the angle θ, the higher the spin amount of a shot. The bottom surface 23 is parallel to the face 10. A depth D0 is the length from the face 10 to the bottom surface 23 as the deepest portion of the score line 20. In case of a golf club head for competitions, the depth D0 must be 0.020 inches (0.508 mm) or less according to the rule.

Figure 3:
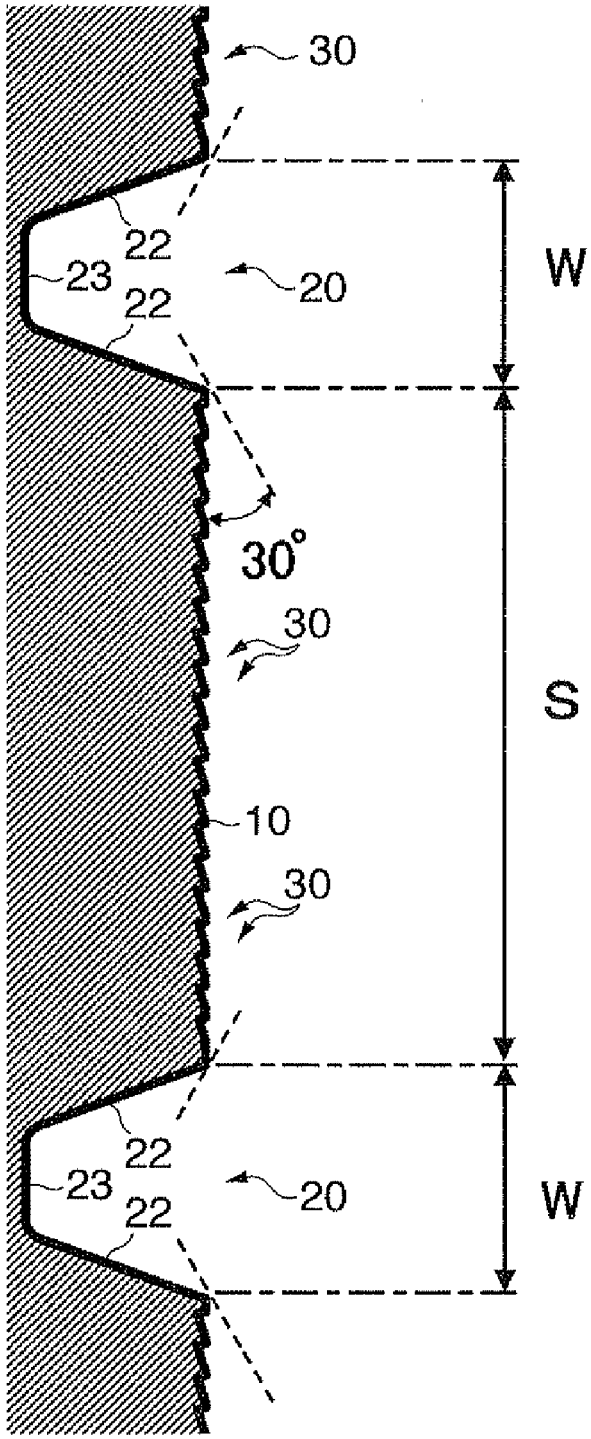
FIG. 3 is a view for explaining a width W of the score line 20 based on the 30 degrees measurement rule and a distance S between the score lines 20.

FIG. 3 is a view for explaining the width W of the score line 20 based on the 30 degrees measurement rule and a distance S between the score lines 20. The width W indicates the width measured based on the so-called 30 degrees measurement rule as a rule about a golf club for competitions. That is, the width W indicates the distance between the contact points of the respective virtual lines with an angle of 30° with respect to the face 10 and the respective edges 21 of the score line 20. The distance S between the score lines 20 indicates the distance between the contact points of the respective virtual lines with an angle of 30° with respect to the face 10 and the respective edges 21 of the score lines 20 adjacent to one another.

For a golf club head for competitions, the cross sectional area, width W, and distance S of the score line 20 must satisfy a cross sectional area A (inches$^2$)/(W(inches)+S(inches)) $\leqq$0.003 (to be referred to as the area rule, hereinafter) according to the rule. The metric system expresses the cross sectional area A (mm$^2$)/(W (mm)+S (mm))$\leqq$0.0762. In order to make the golf club head 1 as a golf club head for competitions, it needs to be designed to satisfy the area rule. If the cross sectional area, width W, and distance S of the score line 20 are designed so as to satisfy a cross sectional area A (inches$^2$)/(W (inches)+S (inches))$\leqq$0.0025, the golf club head can be better insured to meet the area rule.

As a rule about score lines of a golf club head for competitions, in addition to the area rule, each edge of a score line must be positioned within a virtual circle with a radius of 0.011 inches concentric with a virtual circle with a radius of 0.010 inches which internally touches the side surface of the score line and the face (to be referred to as a two-circle rule, hereinafter).

In order to satisfy the two-circle rule, however, it is necessary to decrease the angle (the angle θ described above) between each side surface of the score lines and the face. In this case, not only a decrease in spin amount but also a decrease in the volume of the score line occurs. Accordingly, a spin amount may significantly decrease in case of a shot from the rough or a shot in a rainy day.

Figure 4:
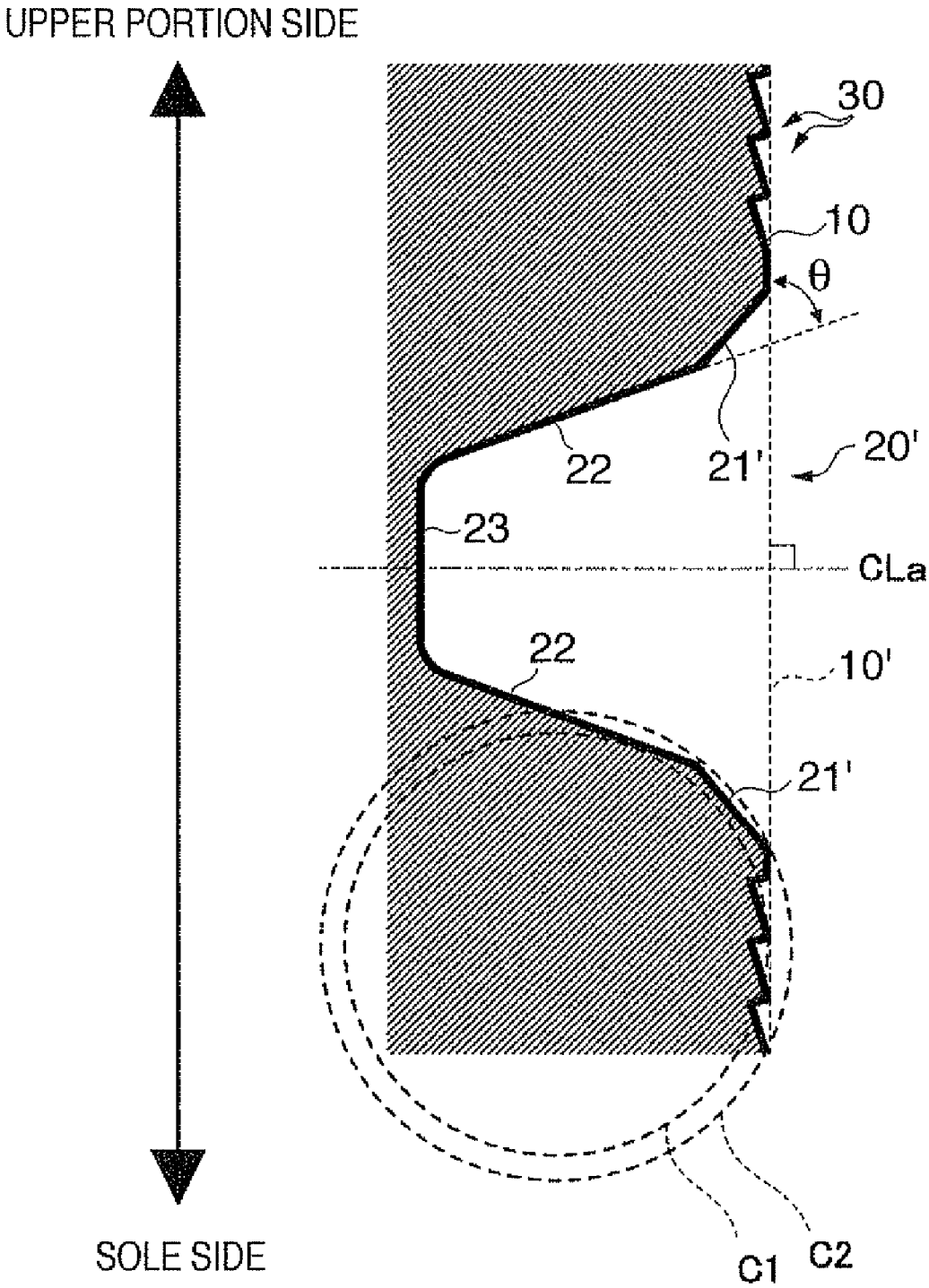
FIG. 4 is a view showing another example (score line 20') of the score line 20.

FIG. 4 is a view showing another example (score line 20') of the score line 20. The same parts as in the score line 20 are denoted by the same reference numerals in the score line 20', and the description thereof will not be repeated. Only the parts different from the score line 20 will be described.

In FIG. 4, a virtual circle C1 is a circle with a radius of 0.01 inches which internally touches the side surface 22 and face 10. A virtual circle C2 is a circle with a radius of 0.011 inches which is concentric with the virtual circle C1. In order to conform to the two-circle rule described above, the edge of the score line 20 needs to be positioned within the virtual inches circle C2.

In the score line 20', a flat surface 21' is formed in an edge portion to conform to the two-circle rule. Note that the shape of the edge may be a rounding or notch other than the flat surface 21'. In order to make the golf club head 1 as a golf club head for competitions, it is designed to satisfy the two-circle rule as well.

The striations 30 will be described next with reference to FIG. 2. In this embodiment, a plurality of the striations 30 are arranged at an equal pitch in a direction (a direction perpendicular to the longitudinal direction of the score line 20) perpendicular to the longitudinal direction of the striation 30. However, the striations 30 need not be arranged at an equal pitch.

The striation 30 includes side surfaces 31 and 32. The cross-sectional shapes of the striations 20 are the same except in two end portions in the longitudinal direction. In this embodiment, the striations 30 have the same cross-sectional shape, but the striations 30 having different cross-sectional shapes may be combined.

The cross-sectional shape of the striation 30, which is defined by the side surfaces 31 and 32 and the dashed line 101 representing the face 10, is a triangle asymmetric with regard to a virtual center line CLb in the direction of a width Ws. The virtual center line CLb is perpendicular to the face 10 and passes the middle point of the width Ws of the striation 30. The intersection portion of the side surfaces 31 and 32 may be rounded.

The triangle as the cross-sectional shape of the striation 30 defined by the side surfaces 31 and 32 and the dashed line 10' representing the face 10 has three interior angles θ1 to θ3. The interior angle θ1 is the angle between the side surface 32 and dashed line 10', the interior angle θ2 is the angle between the side surfaces 31 and 32, and the interior angle θ3 is the angle between the side surface 31. The smallest interior angle θ1 having the smallest angle among the three interior angles θ1 to θ3 is placed at the sole side.

In this manner, when the cross-sectional shape of the striation 30 is formed to be a triangle asymmetric with regard to the virtual center line CLb in the direction of the width Ws and the smallest interior angle θ1 is placed at the sole side, the normal direction of the side surface 31 is further directed to the sole side. When the golf club head 1 hits a golf ball with a slightly descending blow, the side surface 31 catches the ball surface, thereby providing a higher backspin amount of a shot.

As described above, in this embodiment, since the striations 30 are formed in addition to the score lines 20, it is possible to increase the backspin amount of a shot.

A depth D is the length from the face 10 to the deepest portion of the striation 30. The deepest portion corresponds to the intersection point of the side surfaces 31 and 32, and therefore the depth D is the length of a perpendicular from the dashed line 10' to the intersection point of the side surfaces 31 and 32. The larger the depth D, the higher the backspin amount of a shot, but a ball is easily damaged. Accordingly, the depth D is set to 40 μm or less. The smaller the depth D, the less easily a ball is damaged, but the effect of increasing the backspin amount decreases. Accordingly, the depth D is set to 10 μm or more.

A pitch P is the distance between one end of the striation 30 and that of the adjacent striation 30. When the pitch P or width Ws is small, the striations 30 are easily clogged with grass or the like, and the backspin amount of a shot decreases. When the pitch P or width Ws is large, since the number of striations 30 which come into contact with a golf ball at impact decreases, the backspin amount of a shot decreases. Accordingly, the pitch P and width Ws are preferably 100 μm to 800 μm (both inclusive).

Figure 5:
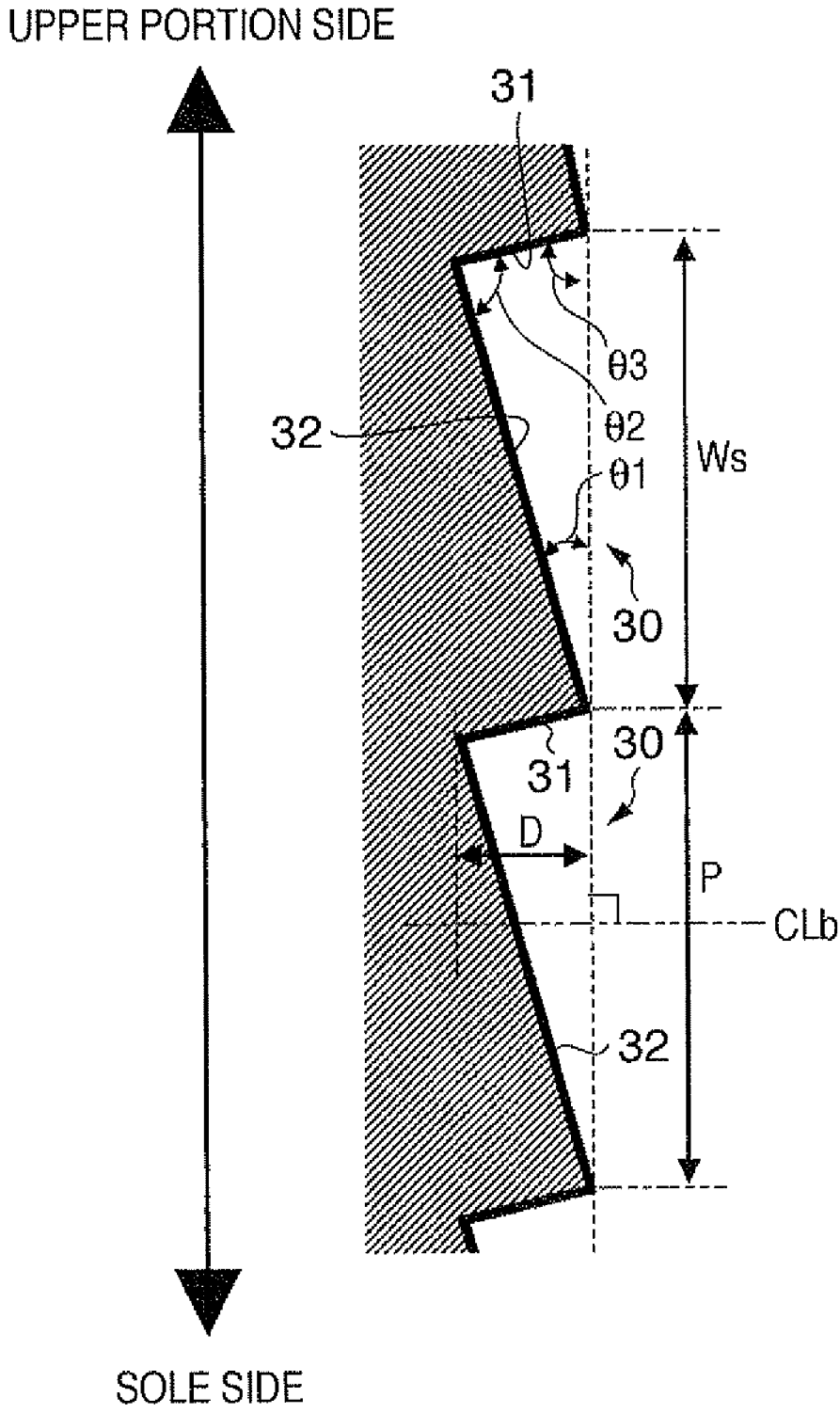
FIG. 5 is a sectional view of the striations 30 continuously formed in the arrangement direction.

The striations 30 may be continuously formed in the arrangement direction. FIG. 5 is a sectional view of the striations 30 continuously formed in the arrangement direction. In the example shown in FIG. 5, the striations 30 adjacent to one another are continuously formed without any gap between them. In this case, the pitch P coincides with the width Ws.

Figure 6A:
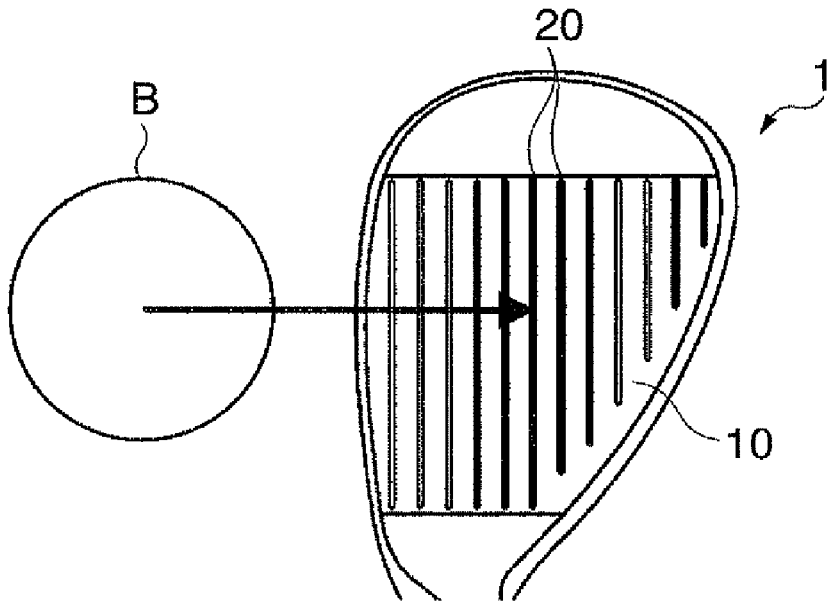
FIG. 6A is a view showing a case in which a face 10 is directed perpendicularly to the target direction.
Figure 6B:
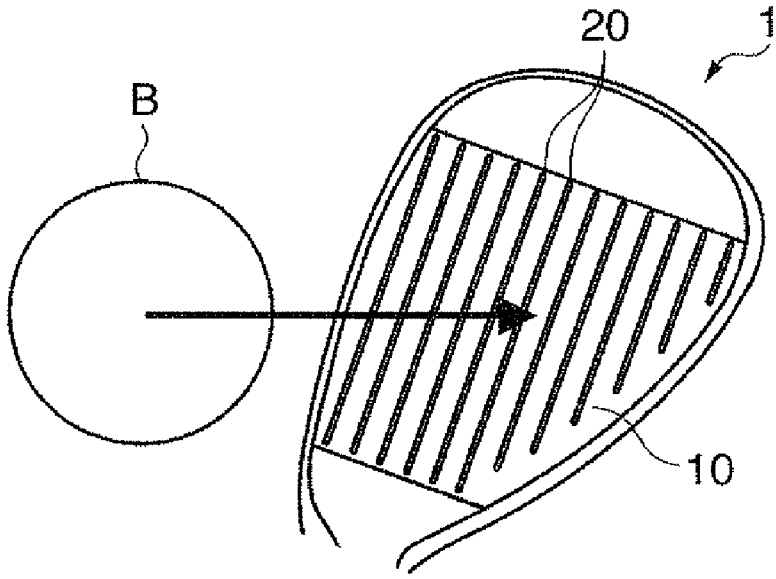
FIG. 6B is a view showing a case in which the face 10 is open.

When using a short iron or wedge, a player sometimes hits a golf ball with the face open so that the backspin amount is easily provided to the ball. FIG. 6A shows a case in which the face 10 is directed perpendicularly to the target direction, and FIG. 6B shows a case in which the face 10 is open. Note that the striations 30 are not shown in FIGS. 6A and 6B. In each of FIGS. 6A and 6B, the arrow represents the relative displacement direction of a golf ball B with respect to the face 10 at impact.

When the face 10 is open as shown in FIG. 6B, the golf ball B slides on the face 10 such that it diagonally crosses the score lines 20 and striations 30 at impact. When the direction (i.e., the arrangement direction) perpendicular to the longitudinal direction of the striations 30 is more parallel to the direction indicated by the arrow in FIG. 6B, the number of the striations 30 on which the golf ball 30 slides increases and backspin is easily provided to the golf ball B. For this reason, the striations 30 may be formed not to be parallel to the score lines 20 but to intersect them.

Figure 7:
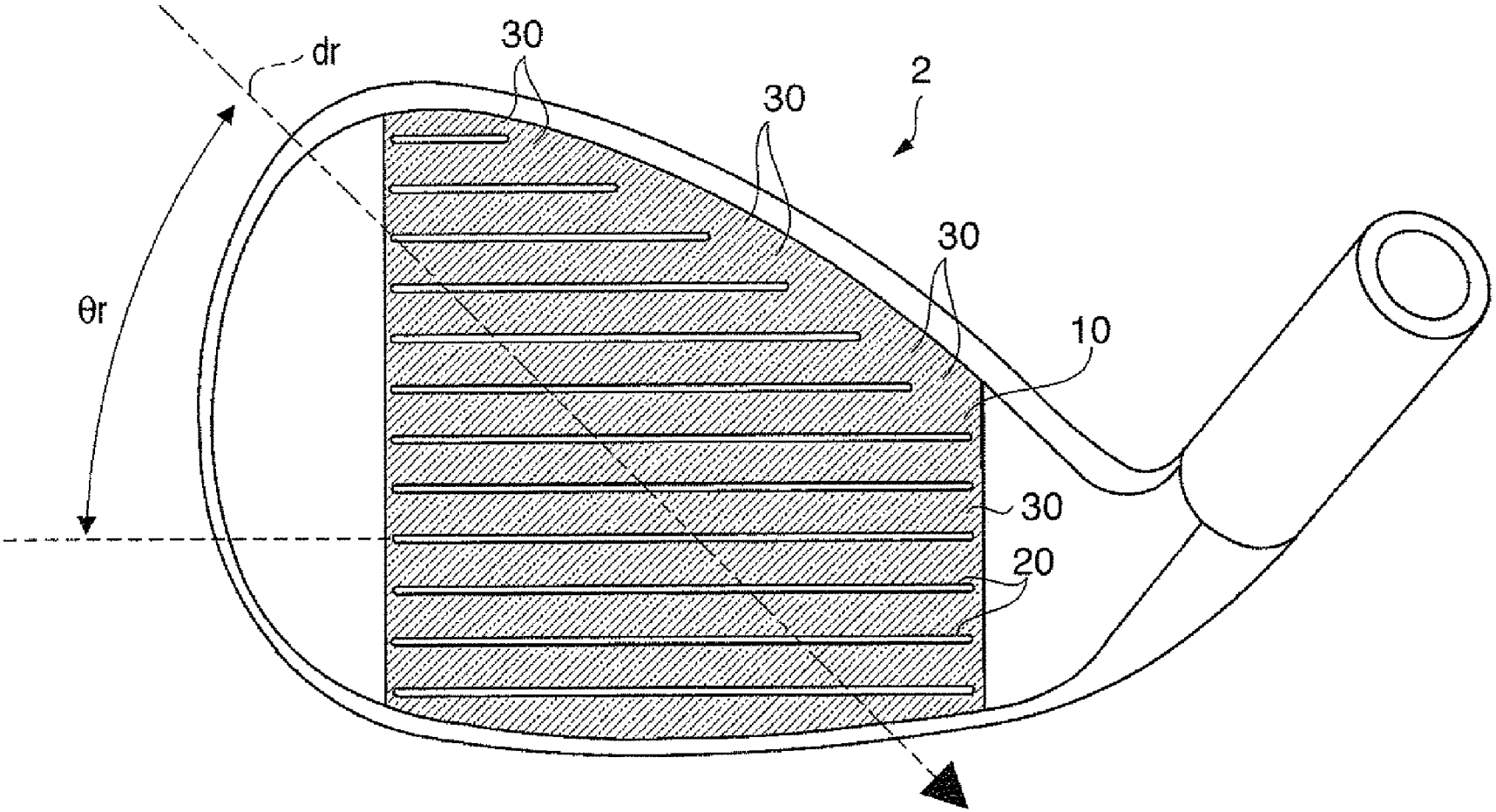
FIG. 7 is a view showing the outer appearance of a golf club head 2 in which striations 30 intersect score lines 20.

FIG. 7 is a view showing the outer appearance of a golf club head 2 in which striations 30 intersect score lines 20. The golf club head 2 is different from the golf club head 1 only in an arrangement direction dr of the striations 30. In the example shown in FIG. 7, an angle θr between the arrangement direction dr and the longitudinal direction of the score line 20 is about 45° in the clockwise direction from the toe side of the score line 20. When the arrangement direction dr of the striations 30 is set as described above, the backspin amount rate of a shot with a face 10 open can be increased.

For example, the angle θr can be set within a range of 20° to 90° (both inclusive). For a short iron or wedge, since a player often hits a ball with the face 10 open, it is desirable to set the angle θr within a range of 40° to 70° (both inclusive).

The striations 30 influence the surface roughness of the face 10. As indices of surface roughness, a maximum height (Ry) and arithmetic mean roughness (Ra) are known. The depth D is associated with a maximum height (Ry). The depth D, width Ws, and pitch P are associated with arithmetic mean roughness (Ra). The larger the arithmetic mean roughness (Ra), the higher the backspin amount of a shot, but a ball is easily damaged. Accordingly, the arithmetic mean roughness of a portion of the face 10 with the striations 30 is preferably 5.0 μm or less. When the arithmetic mean roughness (Ra) is smaller, a ball is rarely damaged, but the effect of increasing the backspin amount decreases. Accordingly, the arithmetic mean roughness of a portion of the face 10 with the striations 30 is preferably 1.0 μm or more, and more preferably 1.5 μm or more.

For a golf club head for competitions, the surface roughness of the face is determined to be 4.57 μm or less in arithmetic mean roughness (Ra) and 25 μm or less at a maximum height (Ry) by the rule. In order to make the golf club heads 1 and 2 as golf club heads for competitions, they are designed to satisfy the rule about surface roughness as well.

More specifically, the depth D is set to be 10 μm to 25 μm (both inclusive). The arithmetic mean roughness of a portion of the face 10 with the striations 30 is set to be 1.0 μm to 4.57 μm (both inclusive), and preferably 1.5 μm to 4.57 μm (both inclusive).

As described above, for a golf club head for competitions, there are certain constraints about the score lines 20 and the surface roughness of the face. It is not easy to increase the backspin amount while satisfying the rules. In this embodiment, the cross-sectional shape of the striation 30 is formed to be a triangle asymmetric with regard to the virtual center line CLb in the direction of the width Ws and the smallest interior angle θ1 is placed at the sole side, so that the normal direction of the side surface 31 is further directed to the sole side. With this arrangement, it is possible to obtain a higher backspin amount even within the constraints based on the rules.

Figure 8A:
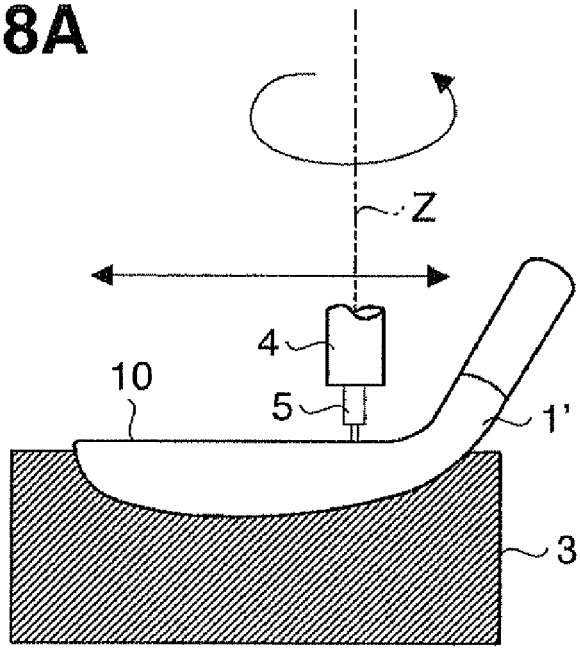
FIGS. 8A and 8B are views for explaining the method of forming the striations 30 by an NC milling machine.
Figure 8B:
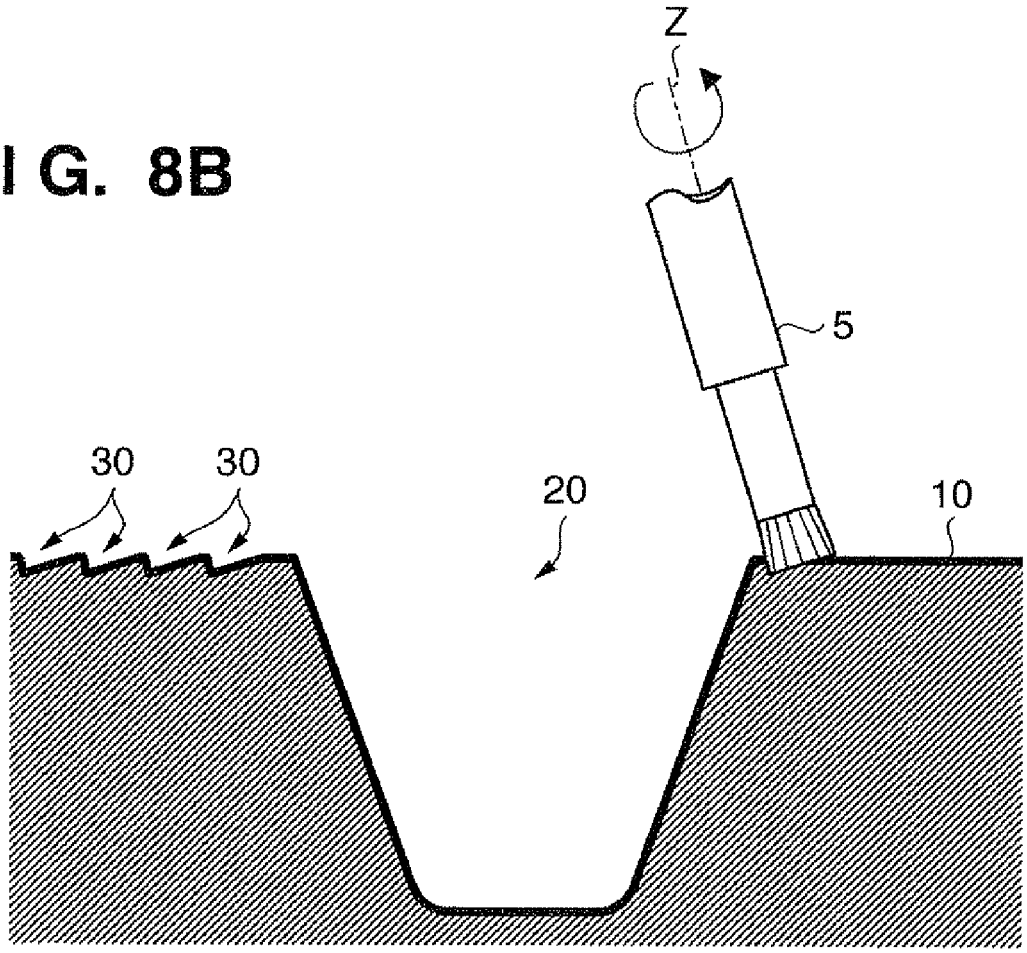

The method of forming the striations 30 will be described next. The striations 30 can be formed as cut traces by milling of the face 10. The striations 30 can be formed by milling by using, for example, an NC (numerically controlled) milling machine. FIGS. 8A and 8B are views for explaining the method of forming the striations 30 by an NC milling machine.

As shown in FIG. 8A, a golf club head 1' without the striations 30 is fixed to the NC milling machine via a jig 2. Note that in this embodiment, a case in which the face 10 is integrally formed with the golf club head is described. However, a face member which forms the face 10 and the head body may be prepared as separated members and joined together. In this case, the face member is fixed to the NC milling machine to form the striations 30. It is assumed that the score lines 20 are already formed in the golf club head 1'. However, the striations 30 may be formed before forming the score lines 20.

The NC milling machine includes a spindle 4 which is rotatably driven around the axis Z. A cutting tool (end mill) 5 is attached to the lower end of the spindle 4. The spindle 4 (i.e., the Z axis) is assumed to be inclinable. As shown in FIG. 8B, the distal shape of the cutting tool 5 is selected depending on the cross-sectional shape of the striation 30.

After setting the plane coordinates of the face 10 in the NC milling machine, the spindle 4 is rotatably driven. The face 10 (golf club head 1') or cutting tool 5 is moved relatively in the formation direction of the striations 30 to cut the face 10. When one striation 30 has been formed, the cutting tool 5 is separated from the face 10. After that, the cutting tool 5 is moved relatively in the arrangement direction of the striations 30, and the next striation 30 is formed. In this manner, the striations 30 are sequentially formed.

Note that as the method of forming the striations 30, another forming method such as electrical discharge machining, casting, or the like can be employed other than milling.

When the striations 30 are formed on the face 10, since the surface hardness of the face 10 decreases, the face 10 may be easily worn out. For this reason, it is preferable to perform surface treatment for increasing the hardness of the face 10 after forming the striations 30. As such surface treatment, cementing, nitriding, soft nitriding, PVD (Physical Vepor Deposition), ion plating, DLC (Diamond Like Carbon) treatment, plating, or the like is available. Particularly, surface treatment such as cementing or nitriding is preferable which reforms a surface without forming another metal layer on it.

EXAMPLES

Golf club heads #1 to #3 and #11 to #17 that were different in presence/absence of striations and their specifications were fabricated, and the rates of backspin and degrees of scratch of balls were evaluated using golf clubs respectively mounted with those golf club heads. FIG. 9 is a table showing the presence/absence of striations and their specifications of golf club heads #1 to #3 and #11 to #17, the evaluation results of the rates of backspin and degrees of scratch of balls, and the rule conformance associated with the surface roughness of the face.

All golf club heads #1 to #3 and #11 to #17 were sand wedges that were different only in presence/absence of striations and their specifications. Striations were not formed in golf club head #1, but formed in golf club heads #2, #3, and #11 to #17. A plurality of striations were formed parallel to score lines, like the golf club head 1 in FIG. 1, and continuously formed in the arrangement direction as shown in FIG. 5. Accordingly, the width of a striation coincides with the pitch.

In FIG. 9, "position of the smallest interior angle" indicates the smallest interior angle among the three interior angles θ1 to θ3 shown in FIG. 2. "Upper portion side" in golf club heads

#2 and #3 means that θ3 is the smallest interior angle in FIG. 2. That is, the cross-sectional shapes of the striations of golf club heads #2 and #3 correspond to the upside-down version of the cross-sectional shape shown in FIG. 2. "Sole side" in golf club heads #11 to #17 means that θ1 is the smallest interior angle in FIG. 2. That is, the cross-sectional shapes of the striations of golf club heads #11 to #17 correspond to the cross sectional shape shown in FIG. 2.

"Depth D" corresponds to the depth D in FIG. 2. In other words, it corresponds to the surface roughness (maximum height: Ry) of the face. "Pitch P" corresponds to the pitch P in FIG. 2. As described above, since the striations are continuously formed in the arrangement direction in golf club heads #2, #3, and #11 to #17, the pitch P also corresponds to the width of the striation (Ws in FIGS. 2 and 5). "Surface roughness (Ra)" indicates the arithmetic mean roughness of the face.

The rates of backspin and the degrees of scratch of balls were evaluated by hitting a plurality of golf balls with each of the golf clubs from the rough about 30 yards away from the green. "Spin rate" in FIG. 9 was evaluated in five levels (A to E) by observing how readily the ball stopped on the green. Level A means that the ball was most readily stopped, that is, the backspin amount was the highest. "Degree of scratch" was evaluated by visually observing the flows of the golf ball after a shot. "Rule conformance" indicates rule conformance for a golf club head for competitions with regard to the roughness of the face. A golf club head with arithmetic mean roughness (Ra) of 4.57 μm or less and a maximum height (Ry) of 25 μm or less is indicated by (○) meaning "conform", and otherwise indicated by (×) meaning "not conform".

From the comparison between golf club head #1 and other golf club heads, it is obvious that the presence/absence of striations influences the backspin amount. From the comparison between golf club heads #2 and #3 and golf club heads #11 to #17, it is obvious that more back spin is obtained when the striation has a cross-sectional shape in which the smallest interior angle is placed at the sole side.

Of golf club heads #11 to #17, golf club head #13 has the highest backspin amount, but the golf balls have some scratches. Accordingly, the depth D is preferably 40 μm or less and, in consideration of rule conformance, needs to be 25 μm or less. In golf club head #11, the backspin amount is not very high and the effect of striations is small. Accordingly, the backspin amount can be increased by setting the depth D to be 10 μm or more.

Consider the pitch P of each of golf club heads #11 to #17. Of golf club heads #14 to #17, the backspin amount are not very high in golf club heads #14 and #17. In golf club heads #15 and #16, the higher rates of backspin are obtained. Accordingly, the pitch P is preferably 100 μm to 800 μm (both inclusive), and more preferably 400 μm to 600 μm (both inclusive).

Consider the surface roughness (Ra) of each of golf club heads #11 to #17. The larger its value, the higher the backspin amount, but the golf balls have some scratches in golf club head #13. On the other hand, almost no scratch is found on golf club head #14. Accordingly, the surface roughness (Ra) is preferably 5.0 μm or less, and is 4.57 μm or less in consideration of rule conformance. In golf club head #17, the backspin amount is not very high. Accordingly, the surface roughness (Ra) is preferably 1.0 μm or more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2008-95417, filed Apr. 1, 2008 and No. 2008-206386, filed Aug. 8, 2008, which are hereby incorporated by reference herein in their entirety.

What is claimed is:

1. A golf club head including a plurality of score lines on a face, comprising a plurality of striations formed on said face and extending from a toe side to a heel side, wherein a cross-sectional shape of each striation is a triangle asymmetric with regard to a virtual center line in a width direction, a smallest interior angle among three interior angles of the triangle being placed at a sole side of said golf club head, a depth D from said face to a deepest portion of each striation satisfies the following expression:

$$10\ \mu m \leqq D \leqq 40\ \mu m, \text{ and}$$

said face in which said striations are formed has an arithmetic mean deviation of the profile (Ra) of between 1.0 μm and 5.0 μm, inclusive.

2. The golf club head according to claim 1, wherein said depth D satisfies the following expression:

$$10\ \mu m \leqq D \leqq 25\ \mu m.$$

3. The golf club head according to claim 1, wherein a pitch P between said striations adjacent to one another satisfies the following expression:

$$100\ \mu m \leqq P \leqq 800\ \mu m.$$

4. The golf club head according to claim 1, wherein said face in which said striations are formed has the arithmetic mean deviation of the profile (Ra) of between 1.5 μm and 4.57 μm, inclusive.

5. The golf club head according to claim 1, wherein said striations are straight grooves parallel to said score lines.

6. The golf club head according to claim 1, wherein an angle between an arrangement direction of said striations and a longitudinal direction of each of said score lines is within a range of 20° to 90° both inclusive.

7. The golf club head according to claim 1, wherein a surface treatment for increasing a hardness of said face is performed.

8. A golf club head including a plurality of score lines on a face, comprising a plurality of striations formed on said face and extending from a toe side to a heel side, wherein a cross-sectional shape of each striation is a triangle asymmetric with regard to a virtual center line in a width direction, a smallest interior angle among three interior angles of the triangle being placed at a sole side of said golf club head, a depth D from said face to a deepest portion of each striation satisfies the following expression:

$$10\ \mu m \leqq D \leqq 40\ \mu m,$$

a cross sectional area A (inches$^2$) of said score line, a width W (inches) of said score line measured based on the 30 degrees measurement rule and a distance S (inches) between said score lines adjacent to one another satisfy the following expression:

$$A/(W+S) \leqq 0.003, \text{ and}$$

edges of said score lines are formed so as to be positioned within a second virtual circle with a radius of 0.011 inches, the second virtual circle being concentric with a first virtual circle which internally touches a side surface of said score line and said face with a radius of 0.010 inches.

9. The golf club head according to claim 8, wherein the cross sectional area A (inches$^2$), the width W (inches) and the distance S (inches) satisfy the following expression:

$$A/(W+S) \leqq 0.0025.$$

10. The golf club head according to claim 8, wherein said depth D satisfies the following expression:

$$10\ \mu m \leqq D \leqq 25\ \mu m.$$

11. The golf club head according to claim 8, wherein a pitch P between said striations adjacent to one another satisfies the following expression:

$$100\ \mu m \leqq P \leqq 800\ \mu m.$$

12. The golf club head according to claim 8, wherein said striations are straight grooves parallel to said score lines.

13. The golf club head according to claim 8, wherein an angle between an arrangement direction of said striations and a longitudinal direction of each of said score lines is within a range of 20° to 90° both inclusive.

14. The golf club head according to claim 8, wherein a surface treatment for increasing a hardness of said face is performed.

15. A golf club head including a plurality of score lines on a face, comprising a plurality of striations formed on said face and extending from a toe side to a heel side, wherein a depth D from said face to a deepest portion of each striation satisfies the following expression:

$$10\ \mu m \leqq D \leqq 40\ \mu m,$$

said face in which said striations are formed has an arithmetic mean deviation of the profile (Ra) of between 1.0 μm and 5.0 μm, inclusive, a cross sectional area A (inches$^2$) of said score line, a width W (inches) of said score line measured based on the 30 degrees measurement rule and a distance S (inches) between said score lines adjacent to one another satisfy the following expression:

$$A/(W+S) \leqq 0.003, \text{ and}$$

edges of said score lines are formed so as to be positioned within a second virtual circle with a radius of 0.011 inches, the second virtual circle being concentric with a first virtual circle which internally touches a side surface of said score line and said face with a radius of 0.010 inches.

16. The golf club head according to claim 15, wherein said face in which said striations are formed has an arithmetic mean deviation of the profile (Ra) of between 1.5 μm and 4.57 μm, inclusive.

17. The golf club head according to claim 15, wherein the cross sectional area A (inches$^2$), the width W (inches) and the distance S (inches) satisfy the following expression:

$$A/(W+S) \leqq 0.0025.$$

18. The golf club head according to claim 15, wherein said depth D satisfies the following expression:

$$10\ \mu m \leqq D \leqq 25\ \mu m.$$

19. The golf club head according to claim 15, wherein a pitch P between said striations adjacent to one another satisfies the following expression:

$$100\ \mu m \leqq P \leqq 800\ \mu m.$$

20. The golf club head according to claim 15, wherein said striations are straight grooves parallel to said score lines.

21. The golf club head according to claim 15, wherein an angle between an arrangement direction of said striations and a longitudinal direction of each of said score lines is within a range of 20° to 90° both inclusive.

22. The golf club head according to claim 15, wherein a surface treatment for increasing a hardness of said face is performed.

* * * * *